US007009582B2

(12) United States Patent
Shin

(10) Patent No.: US 7,009,582 B2
(45) Date of Patent: Mar. 7, 2006

(54) METHOD AND APPARATUS FOR DRIVING PLASMA DISPLAY PANEL UTILIZING ASYMMETRY SUSTAINING

(75) Inventor: Seong Cheol Shin, Taegu-shi (KR)

(73) Assignee: LG Electronics Inc., Seoul (KR)

( * ) Notice: Subject to any disclaimer, the term of this patent is extended or adjusted under 35 U.S.C. 154(b) by 683 days.

(21) Appl. No.: 09/836,204

(22) Filed: Apr. 18, 2001

(65) Prior Publication Data

US 2001/0033257 A1 Oct. 25, 2001

(30) Foreign Application Priority Data

Apr. 19, 2000 (KR) ..... 2000-20795

(51) Int. Cl.
*G09G 3/10* (2006.01)

(52) U.S. Cl. ..... 345/60; 345/61; 345/67; 345/204; 315/169.4

(58) Field of Classification Search ..... 345/60–70, 345/204–206; 315/169.1–169.4; 348/797
See application file for complete search history.

(56) References Cited

U.S. PATENT DOCUMENTS

| | | | | |
|---|---|---|---|---|
| 5,995,069 | A * | 11/1999 | Tokunaga et al. | 345/60 |
| 6,188,374 | B1 * | 2/2001 | Moon | 345/60 |
| 6,229,516 | B1 * | 5/2001 | Kim et al. | 345/103 |
| 6,243,073 | B1 * | 6/2001 | Kawamura et al. | 345/168 |
| 6,262,699 | B1 * | 7/2001 | Suzuki et al. | 345/68 |
| 6,271,809 | B1 * | 8/2001 | Kim | 345/60 |
| 6,388,643 | B1 * | 5/2002 | Huang | 345/60 |
| 6,529,177 | B1 * | 3/2003 | Nakamura | 345/60 |
| 2002/0135544 | A1 * | 9/2002 | Myung | 345/60 |

FOREIGN PATENT DOCUMENTS

| | | |
|---|---|---|
| KR | 1999-0070803 | 2/1998 |
| KR | 1998-081100 | 4/1998 |

* cited by examiner

*Primary Examiner*—Lun-yi Lao
(74) *Attorney, Agent, or Firm*—Fleshner & Kim, LLP

(57) ABSTRACT

A PDP driving method that is adaptive for a high-speed driving. In the method, an upper driving signal is applied to supply a data to address electrode lines provided at an upper block. A lower driving signal is applied to supply a data to address electrode lines provided at a lower block in such a manner to overlap with the upper driving signal.

22 Claims, 6 Drawing Sheets

METHOD AND APPARATUS FOR DRIVING PLASMA DISPLAY PANEL UTILIZING ASYMMETRY SUSTAINING

BACKGROUND OF THE INVENTION

1. Field of the Invention

This invention relates to a technique for driving a plasma display panel, and more particularly to a plasma display panel driving method and apparatus employing an asymmetry sustaining that is adaptive for a high-speed driving.

2. Description of the Related Art

Recently, a plasma display panel (PDP) feasible to a manufacturing of a large-size panel has been highlighted as a flat panel display device. The PDP typically includes a three-electrode, alternating current (AC) surface discharge PDP that has three electrodes and is driven with an AC voltage as shown in FIG. 1.

Referring to FIG. 1, a discharge cell of the three-electrode, AC surface discharge PDP includes a scanning/sustaining electrode 12Y and a common sustaining electrode 12Z formed on an upper substrate 10, and an address electrode 20X formed on a lower substrate 18. On the upper substrate 10 in which the scanning/sustaining electrode 12Y is formed in parallel to the common sustaining electrode 12Z, an upper dielectric layer 14 and a protective film 16 are disposed. Wall charges generated upon plasma discharge are accumulated in the upper dielectric layer 14. The protective film 16 prevents a damage of the upper dielectric layer 14 caused by the sputtering generated during the plasma discharge and improves the emission efficiency of secondary electrons. This protective film 16 is usually made from MgO.

A lower dielectric layer 22 and barrier ribs 24 are formed on the lower substrate 18 provided with the address electrode 20X, and a fluorescent material 26 is coated on the surfaces of the lower dielectric layer 22 and the barrier ribs 24. The address electrode 20X is formed in a direction crossing the scanning/sustaining electrode 12Y and the common sustaining electrode 12Z. The barrier ribs 24 are formed in parallel to the address electrode 20X to prevent an ultraviolet ray and a visible light generated by the discharge from being leaked to the adjacent discharge cells. The fluorescent material 26 is excited by an ultraviolet ray generated upon plasma discharge to produce a red, green or blue color visible light ray. An inactive gas for a gas discharge is injected into a discharge space defined between the upper/lower substrate and the barrier rib.

Referring to FIG. 2, a PDP 30 adopting a block division system is divided into an upper block 38 and a lower block 40 for a driving. A discharge cell 1 is provided at each intersection among scanning/sustaining electrode lines Y1 to Ym, common sustaining electrode lines Z1 to Zm and address electrode lines X11 to X1n and X21 to X2n. The address electrode lines X11 to X1n and X21 to X2n are opened at a boundary line between the upper block 38 and the lower block 40.

A driving apparatus for driving such a PDP 30 includes a first scanning/sustaining driver 32A connected to the scanning/sustaining electrode lines Y1 to Ym/2 in the upper block 38, a second scanning/sustaining driver 32B connected to the scanning/sustaining electrode lines Ym/2+1 to Ym in the lower block 40, a common sustaining driver 34 connected to the common sustaining electrode lines Z1 to Zm, a first address driver 36A connected to the address electrode lines X11 to X1n in the upper block 38, a second address driver 36B connected to the address electrode lines X21 to X2n in the lower block 40, and a controller for controlling the first and second drivers 36A and 36B.

The controller 39 applies control signals XE/Rup, Xsusup, XE/Rdn and Xsusdn for energy recovery circuits included in the first and second address drivers 36A and 36B to the first and second address drivers 36A and 36B. The first scanning/sustaining driver 32A applies a scanning pulse and a sustaining pulse to the scanning/sustaining electrode lines Y1 to Ym/2 in the upper block 38. The second scanning/sustaining driver 32B applies a scanning pulse and a sustaining pulse to the scanning/sustaining electrode lines Ym/2+1 to Ym in the lower block 40.

The first address driver 36A applies a data pulse synchronized with the scanning pulse to the address electrode lines X1 to X1n in the upper block 38. The second address driver 36B applies a data pulse synchronized with the scanning pulse to the address electrode lines X21 to X2n in the lower block 40. The common sustaining driver 34 applies a sustaining pulse to all the common sustaining electrode lines Z1 to Zm included in the upper/lower blocks 38 and 40 simultaneously.

Such a PDP 30 divides one frame into a plurality of sub-fields having a different discharge frequency for a driving so as to express a gray level of a picture. Each sub-field is again divided into a reset interval for uniformly causing a discharge, an address interval for selecting the discharge cell and a sustaining interval for expressing the gray level depending on the discharge frequency. For instance, when it is intended to display a picture of 256 gray levels, a frame interval equal to 1/60 second (i.e. 16.67 msec) is divided into 8 sub-fields. Each of the 8 sub-fields is again divided into a reset interval, an address interval and a sustaining interval. The reset interval and the address interval of each sub-field are equal, whereas the sustaining interval is increased at a ration of $2^n$ (wherein n=0, 1, 2, 3, 4, 5, 6 and 7). Since the sustaining interval becomes different at each sub-field as mentioned above, the gray levels of a picture can be expressed.

A driving of such a PDP 30 requires a high voltage more than hundreds of volts. Accordingly, a driving circuit of the PDP 30 is provided with an energy recovery circuit so as to reduce a power consumption of the PDP 30. The energy recovery circuit recovers a voltage charged between the address electrode lines X and re-uses it as a driving voltage upon the next discharge.

FIG. 3 shows an energy recovery circuit installed in the first address driver 36A.

Referring to FIG. 3, the energy recovery circuit 42 includes an inductor L connected, in series, between a data supplier 44 and a source capacitor Cs, first and third switches S1 and S3 connected, in parallel, between the source capacitor Cs and the inductor L, and second and fourth switches S2 and S4 connected, in parallel, between the inductor L and the data supplier 44. The data supplier 44 includes fifth and sixth switches S5 and S6 connected, in parallel, between a panel capacitor Cp and the energy recovery circuit 42.

The panel capacitor Cp is an equivalent expression of a capacitance formed between the address electrode lines X11 to X1n in the upper block 38. The second switch S2 is connected to a data voltage source Vd while the fourth and sixth switches S4 and S6 are connected to a ground voltage source GND. The source capacitor Cs recovers and charges a voltage charged in the panel capacitor Cp and re-applies the charged voltage to the panel capacitor Cp. The inductor L forms a resonant circuit along with the panel capacitor Cp.

The fifth switch S5 is turned on upon application of the data pulse while being turned off upon non-application of the data pulse.

The first switch S1 is turned on when a rising-edge enable signal XE/Rup is applied from the controller 39. The second switch S2 is turned on when an external sustaining voltage Xsusup is applied from the controller 39. The second switch S2 is turned on when a falling-edge enable signal XE/Rdn is applied from the controller 39. The fourth switch S4 is turned on when an external sustaining disable signal Xsusdn is applied from the controller 39.

The energy recovery circuit included in the second address driver 36B is formed symmetrically with respect to the energy recovery circuit provided at the first address driver 36B around the panel capacitor Cp. The rising-edge enable signal XE/Rup, the external sustaining voltage Vsusup, the falling-edge enable signal XE/Rdn and the external sustaining disable signal Xsusdn are applied to the energy recovery circuit included in the upper/lower blocks 38 and 40 at the same timing.

An operation process of the energy recovery circuit included in the first and second address drivers 36A and 36B will be described with reference to FIG. 4.

First, an external sustaining voltage Xsusup is applied to the energy recovery circuit after a rising-edge enable signal XE/Rup was applied thereto. When the rising-edge enable signal XE/Rup is applied to the energy recovery circuit, a voltage charged in the source capacitor Cs is applied to the address electrode lines X11 to X1n and X21 to X2n. Then, driving signals XTop and XBottom of the address drivers 36A and 36B is raised into a sustaining level, that is, a stabilizing level prior to application of the external sustaining voltage Xsusup. The external sustaining voltage Xsusup is applied after voltage levels of the driving signals XTop and XBottom were raised into the sustaining level, to maintain the voltage levels of the driving signals XTop and XBottom at the sustaining level. At this time, a clock signal XCLK and a video data Xdata are supplied to the address drivers 36A and 36B in the upper and lower blocks 38 and 40, respectively. In other words, the video data Xdata and the clock signal XCLK as a low voltage are applied in a period at which the sustaining voltage level is stabilized so as to prevent a waveform distortion caused by a high voltage.

Subsequently, a falling-edge enable signal XE/Rdn is applied to the energy recovery circuit. When the falling-edge enable signal XE/Rdn is applied to the energy recovery circuit, the driving signals XTop and XBottom of the address drivers 36A and 36B begins a falling. At this time, the source capacitor Cs of the energy recovery circuit recovers and charges a voltage discharged from the address electrode lines X11 to X1n and X21 and X2n.

An external sustaining disable signal Xsusdn is applied to the energy recovery circuit at a half time of the falling-edge enable signal XE/Rdn. Then, the driving signals XTop and XBottom of the address drivers 36A and 36B fall into a ground voltage level. Meanwhile, the first and second scanning/sustaining drivers 32A and 32B sequentially apply negative scanning pulses YTopSCAN and YBottomSCAN synchronized with a video data pulse for each block.

However, the conventional PDP driving method has a problem in that, since the video data Xdata and the clock signal XCLK should be applied only in a period at which the driving signals XTop and XBottom of the address drivers 36A and 36B are stabilized, a scanning interval is lengthened. In other words, since a period at which the rising-edge enable signal XE/Rup and the falling-edge enable signal XE/Rdn of the energy recovery circuit are generated is added to the scanning interval besides a period at which a video data is provided, a scanning interval is lengthened to that extent.

For instance, assuming that a time required for applying video data for the upper and lower blocks 38 and 40 to each address driver 38 and 36B is 1.2 $\mu$s and a time for dividing video data for the upper and lower blocks 38 and 40 is 0.1 $\mu$s, total scanning interval becomes 2.5 $\mu$s. Since a video data having a low voltage (i.e., 5V) is transferred to the address drivers 36A and 36B in the upper and lower blocks 38 and 40 at a control circuit board (not shown) for this 2.5 $\mu$s, driving signals of the address drivers 36A and 36B having a high voltage (i.e., 70 to 80V) must be stabilized into the sustaining level. Accordingly, since a high sustaining voltage must be stabilized for 2.5 $\mu$s, a period at which the rising-edge and falling-edge enable signals of the energy recovery circuit are generated is added to the scanning interval.

Since a time occupied by an address interval within one frame becomes long as the scanning interval is lengthened as mentioned above, a time assigned for a sustaining interval is relatively reduced. As a result, the conventional driving method has a limit in a high-speed driving as well as a restriction in a high-resolution display of a picture.

SUMMARY OF THE INVENTION

Accordingly, it is an object of the present invention to provide a PDP driving method and apparatus that is adaptive for a high-speed driving.

In order to achieve these and other objects of the invention, a plasma display panel driving method utilizing an asymmetry sustaining according to one aspect of the present invention includes the steps of applying an upper driving signal for supplying a data to address electrode lines provided at an upper block and applying a lower driving signal for supplying a data to address electrode lines provided at a lower block in such a manner to overlap with the upper driving signal.

The plasma display panel driving method further includes the steps of driving an energy recovery circuit at said application time of said driving signals to raise said driving signals into a stable voltage level; and driving the energy recovery circuit after said data was supplied to the corresponding block, thereby falling said driving signals into a ground voltage level.

A driving apparatus for a plasma display panel utilizing an asymmetry sustaining according to another aspect of the present invention includes a first address driver for driving first address electrode lines included in an upper block; a second address driver for driving second address electrode lines included in a lower block; and control means for applying first and second control signals having a desired phase difference to control an energy recovery circuit included in each of the first and second address drivers.

The plasma display panel driving apparatus further includes a first scanning/sustaining driver for driving scanning/sustaining electrode lines included in the upper block; a second scanning/sustaining driver for driving scanning/sustaining electrode lines included in the lower block; and a common sustaining driver for driving common sustaining electrode lines included in the upper and lower blocks.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
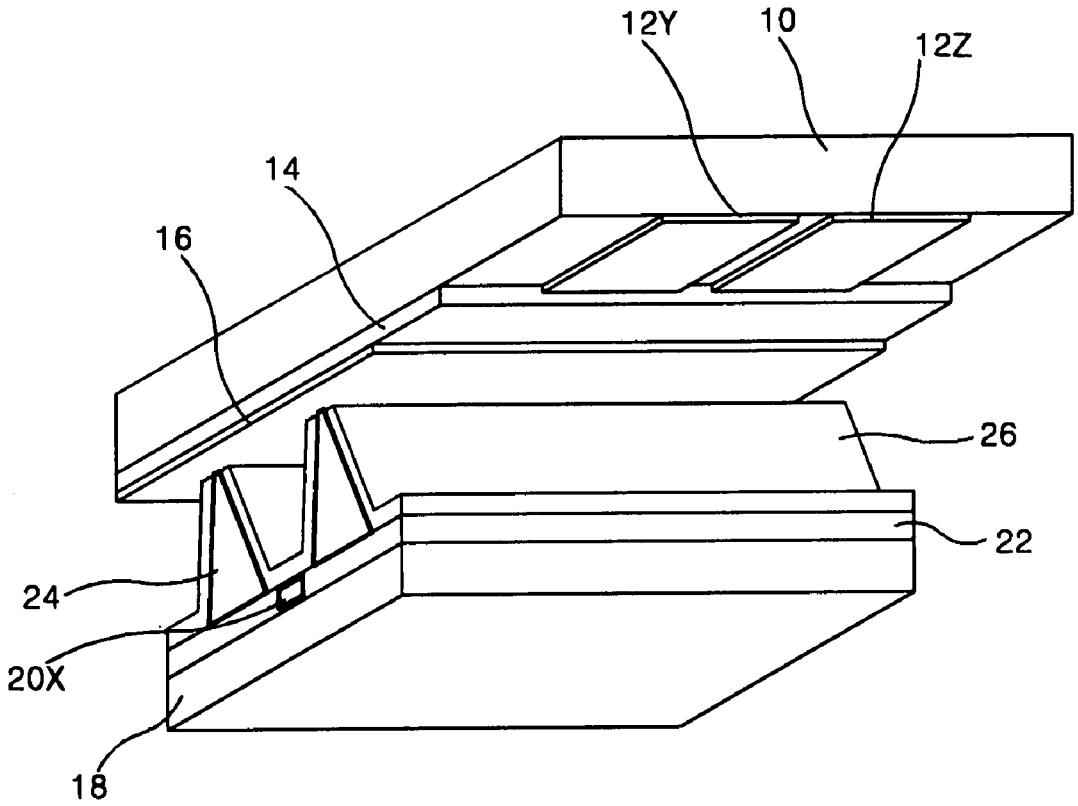
FIG. 1 CONVENTIONAL ART
FIG. 1 is a perspective view showing a discharge cell structure of a conventional three-electrode AC surface-discharge plasma display panel.
Figure 2:
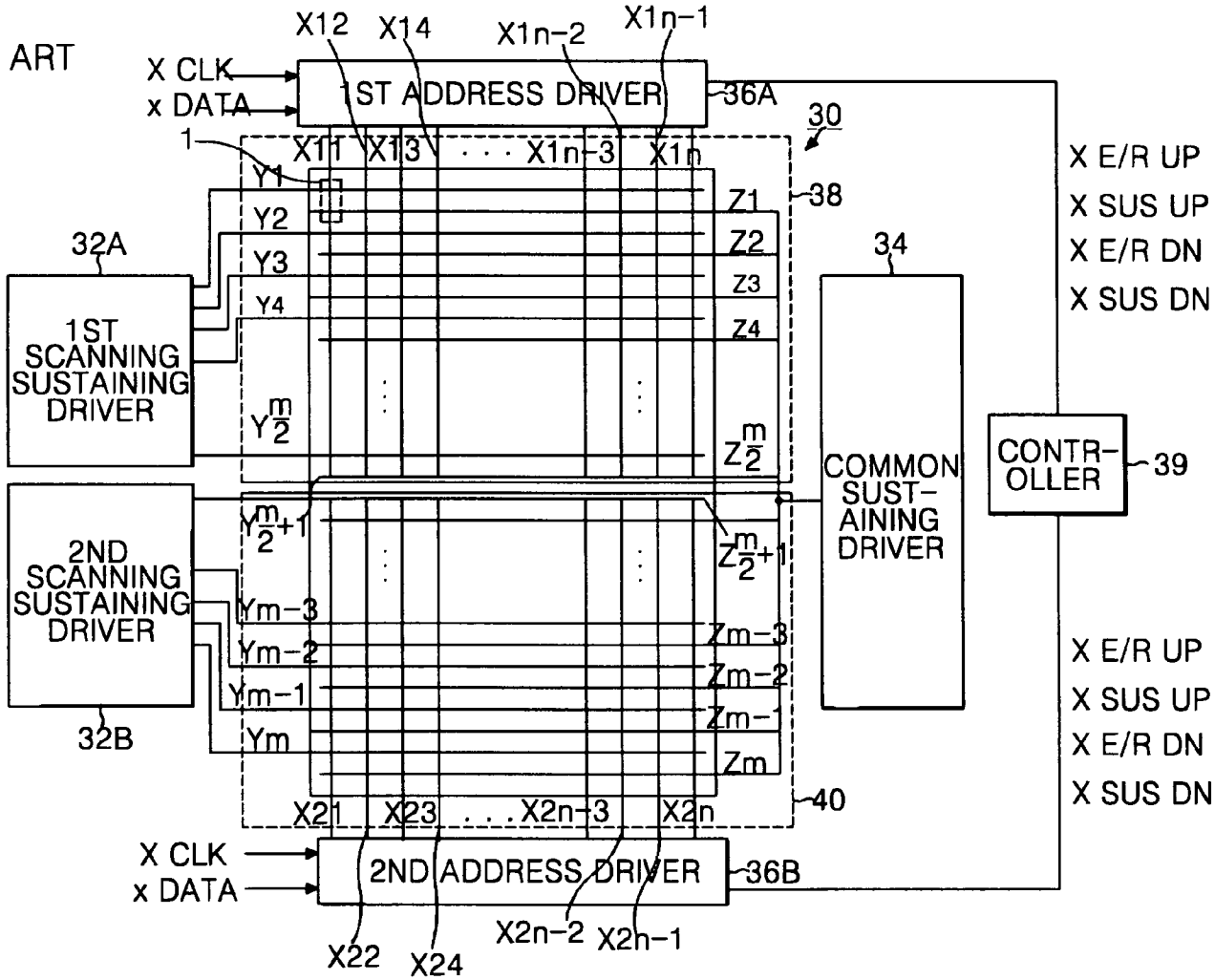
FIG.2 CONVENTIONAL ART
FIG. 2 is a block diagram of a plasma display panel in which the discharge cells shown in FIG. 1 are arranged in a matrix type and a driving apparatus thereof.
Figure 3:
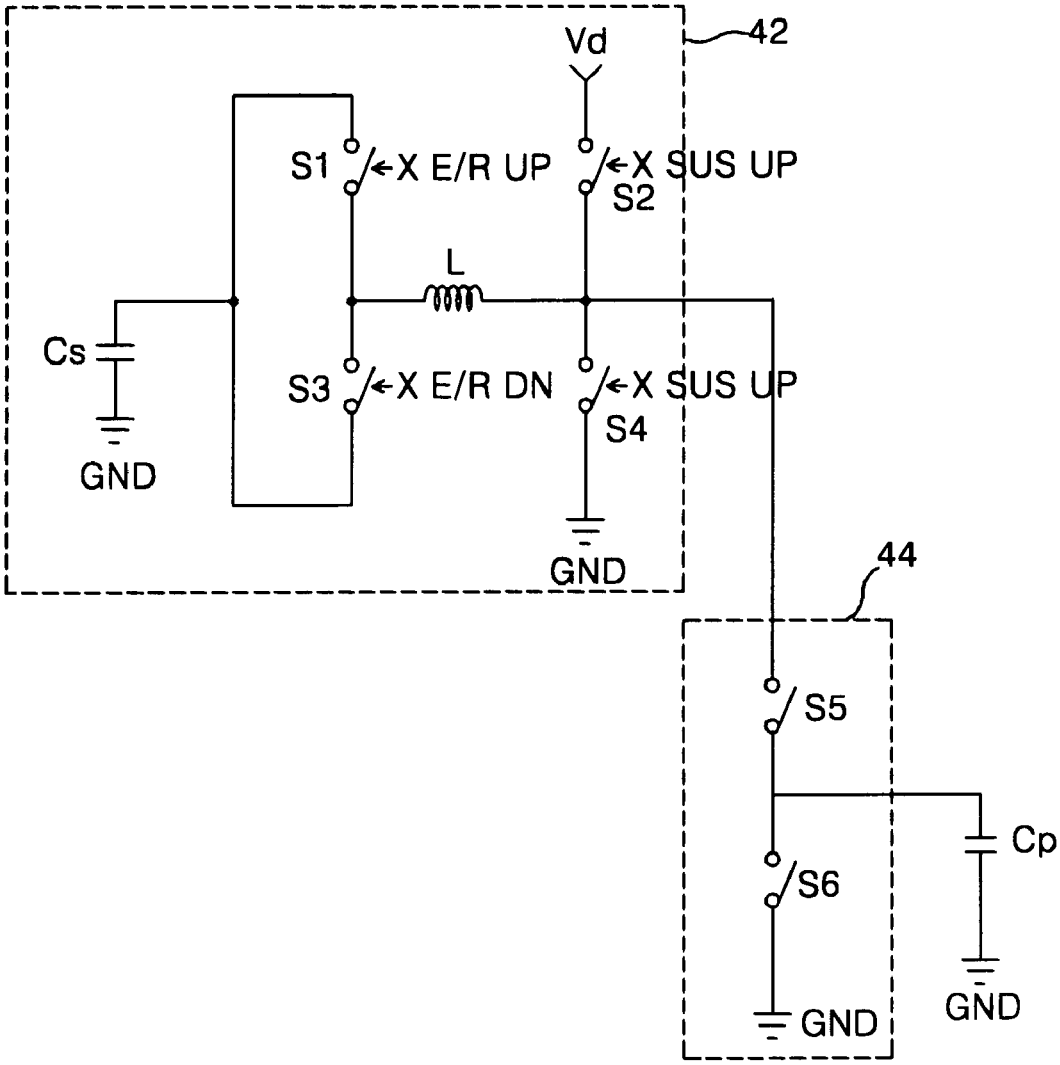
FIG.3 CONVENTIONAL ART
FIG. 3 is a detailed circuit diagram of an energy recovery circuit included in the address driver shown in FIG. 2.
Figure 4:
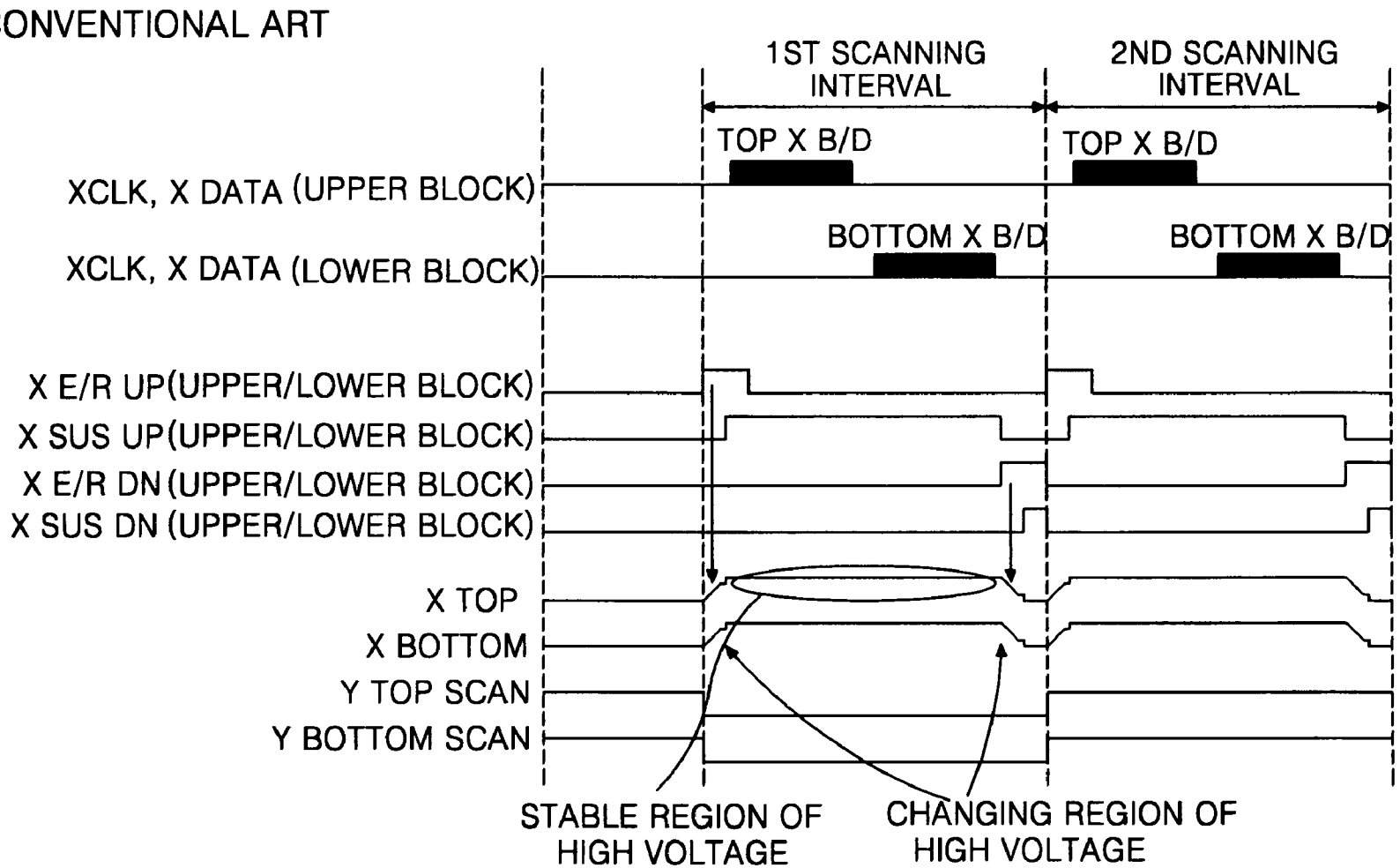
FIG. 4 CONVENTIONAL ART
FIG. 4 is a waveform diagram of driving signals applied to the energy recovery circuit shown in FIG. 3.
Figure 5:
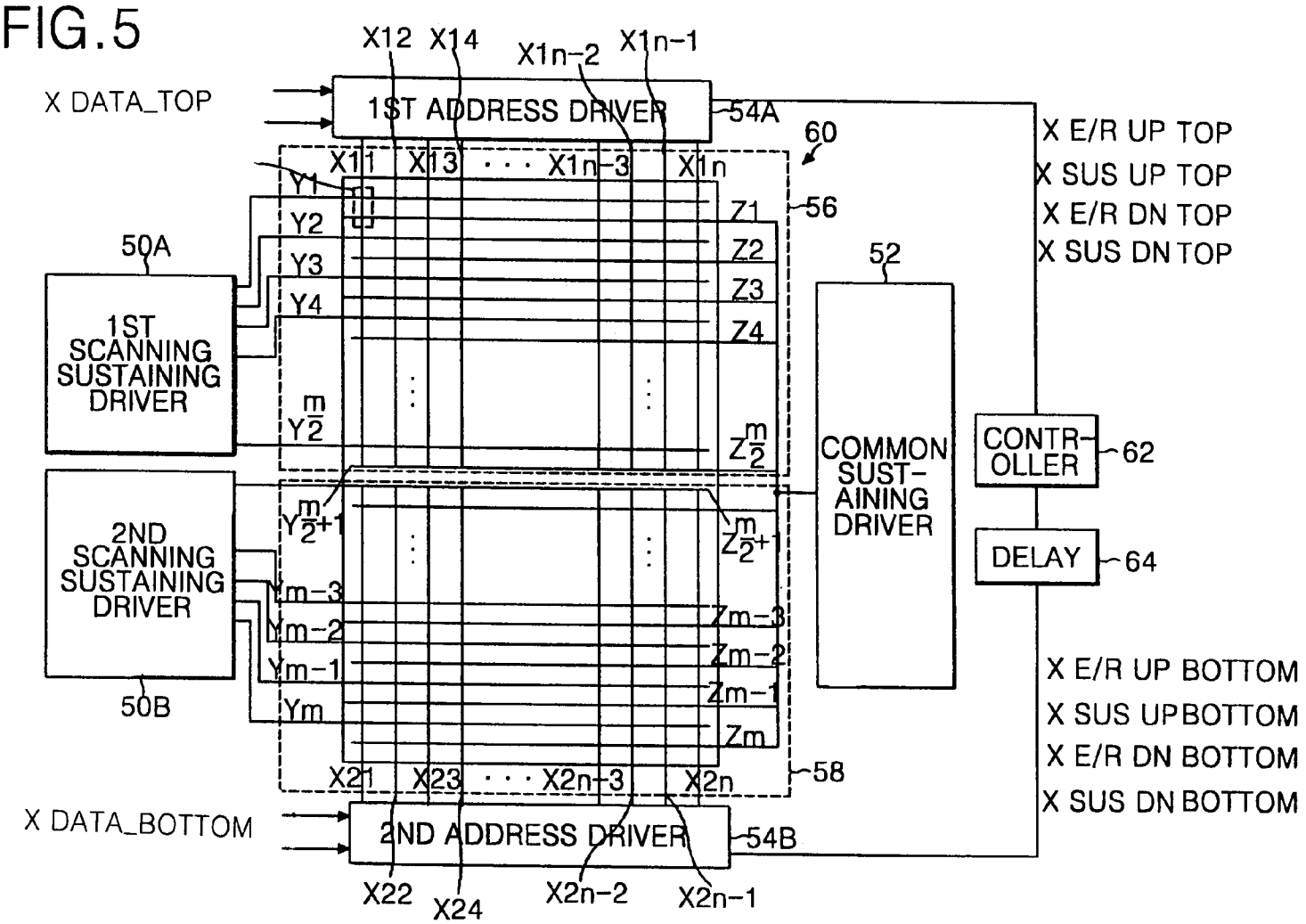
FIG. 5 is a block diagram of a plasma display panel of block division system according to an embodiment of the present invention and a driving apparatus thereof.

Referring to FIG. 5, there is shown a plasma display panel (PDP) 60 adopting a block division system according to an embodiment of the present invention. The PDP 60 of block division system is divided into an upper block 56 and a lower block 58 for a driving. A discharge cell 1 is provided at each intersection among scanning/sustaining electrode lines Y1 to Ym, common sustaining electrode lines Z1 to Zm and address electrode lines X1 to X1n and X21 to X2n. The address electrode lines X1 to X1n and X21 to X2n are opened at a boundary line between the upper block 56 and the lower block 58.

A driving apparatus for driving such a PDP 60 includes a first scanning/sustaining driver 50A connected to the scanning/sustaining electrode lines Y1 to Ym/2 in the upper block 56, a second scanning/sustaining driver 50B connected to the scanning/sustaining electrode lines Ym/2+1 to Ym in the lower block 58, a common sustaining driver 52 connected to the common sustaining electrode lines Z1 to Zm, a first address driver 54A connected to the address electrode lines X1 to X1n in the upper block 56, a second address driver 54B connected to the address electrode lines X21 to X2n in the lower block 58, and a controller 62 for controlling the first and second drivers 54A and 54B.

The controller 62 applies control signals for controlling energy recovery circuits included in the first and second address drivers 54A and 54B to the first and second address drivers 54A and 54B. A delay 64 is provided between the controller 62 and the second address driver 54B. The delay 64 delays the control signals applied from the controller 62 to the second address driver 54B by a desired time.

The first and second scanning/sustaining drivers 50A and SOB apply a scanning pulse and a sustaining pulse to the scanning/sustaining electrode lines Y1 to Ym in the upper and lower blocks 56 and 58. The first and second address drivers 54A and 54B apply a data pulse synchronized with the scanning pulse to the address electrode lines X1 to X1n and X21 to X2n in the upper and lower blocks 56 and 58. The common sustaining driver 52 applies a sustaining pulse to all the common sustaining electrode lines Z1 to Zm included in the upper/lower blocks 56 and 58 simultaneously.

Figure 6:
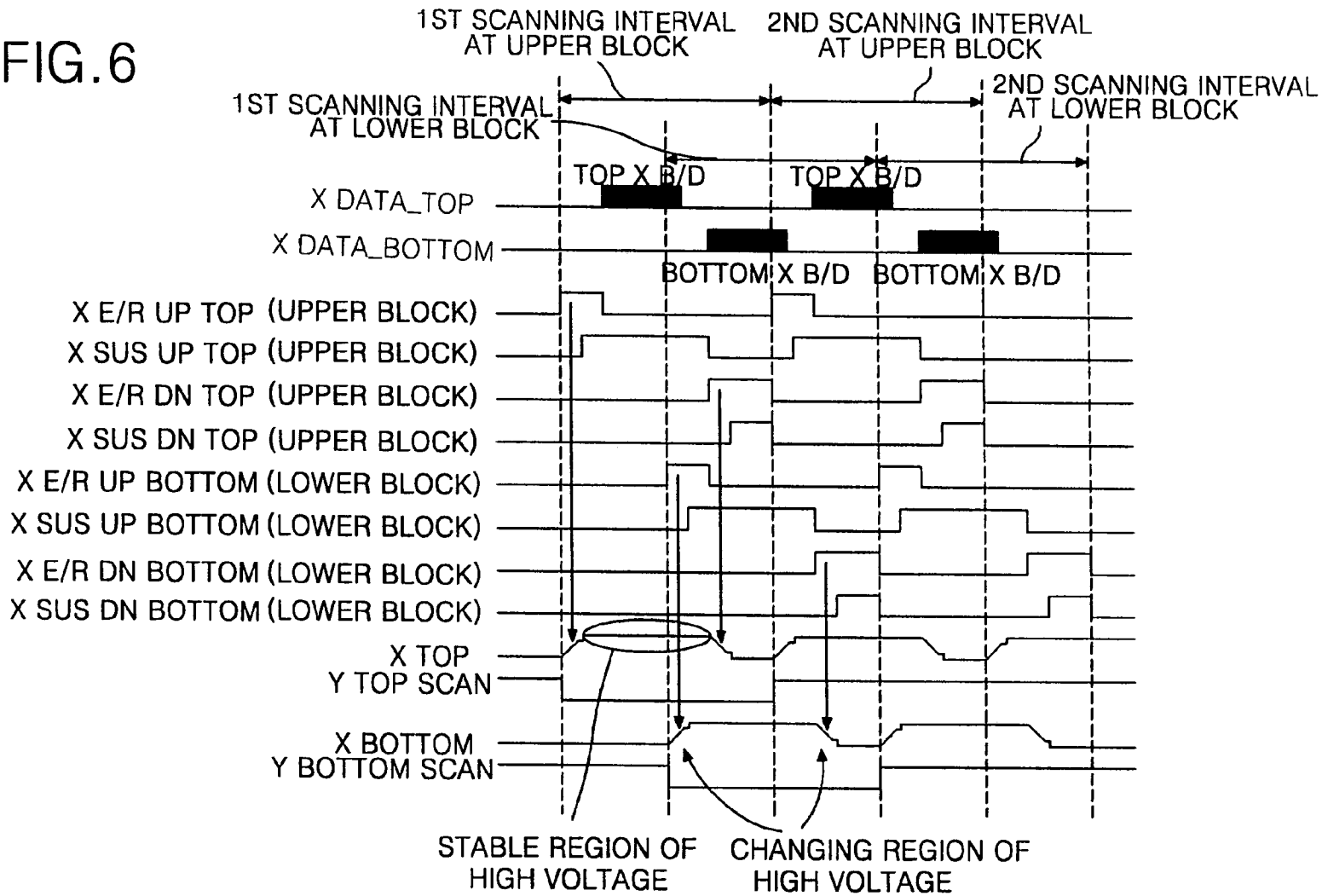
FIG. 6 is a waveform diagram for explaining a plasma display panel driving method utilizing an asymmetry sustaining according to an embodiment of the present invention.

FIG. 6 shows a driving waveform diagram for explaining a PDP driving method according to an embodiment of the present invention.

Referring to FIG. 6, high-voltage driving signals XTop and XBottom are applied to the address electrode lines X1 to X1n and X21 to X2n in the upper and lower blocks 56 and 58 in such a manner to have a desired phase difference therebetween.

More specifically, first, a rising-edge enable signal XE/RupTop is applied to the energy recovery circuit in the upper block 56. When the rising-edge enable signal XE/RupTop is applied to the energy recovery circuit in the upper block 56, a voltage charged in a source capacitor is applied to the address electrode lines X1 to X1n. Then, driving signal XTop of the address driver 54A in the upper block is raised into a sustaining level, that is, a stabilizing level.

An external sustaining voltage XsusupTop is applied after the driving signal XTop was raised into the sustaining level, to maintain the voltage level of the driving signal XTop at the sustaining level. When the voltage level of the driving signal XTop remains at the sustaining level, a clock signal XCLK_TOP and a video data Xdata_top corresponding to the upper block 56 are supplied to the address driver 54A. At this time, a rising-edge enable signal XE/RupBottom is applied to the energy recovery circuit in the upper block 58. In other words, the control signals applied to the lower block 58 is more delayed, by a desired time, than the control signals applied to the upper block 56.

When the rising-edge enable signal XE/RupBottom is applied to the energy recovery circuit in the lower block 58, a voltage charged in the source capacitor is applied to the address electrode lines X21 to X2n. Then, a driving signal XBottom of the address driver 54B in the lower block 58 is raised into the sustaining level.

An external sustaining voltage XsusupBottom is applied after the driving signal XBottom was raised into the sustaining level, to maintain the voltage level of the driving signal XBottom at the sustaining level. When the voltage level of the driving signal XBottom remains at the sustaining level, a clock signal XCLK_BOT and a video data Xdata_bottom corresponding to the lower block 58 are supplied to the address driver 54B.

Meanwhile, when the external sustaining voltage XsusupBottom is applied to the energy recovery circuit in the lower block 58, a falling-edge enable signal XE/RdnTop is applied to the energy recovery circuit in the upper block 56. If the falling-edge enable signal XE/RdnTop is applied to the energy recovery circuit in the upper block 56, the driving signal XTop begins to fall. At this time, the source capacitor of the energy recovery circuit in the upper block 56 recovers and charges a voltage discharged from the address electrode lines X11 to X1n. An external sustaining disable signal XsusdnTop is applied to the energy recovery circuit at a half time of the falling-edge enable signal XE/RdnTop. Then, the driving signal XTop of the address driver 54A drops into a ground voltage level.

Likewise, after all the video data were supplied to the address electrode lines X21 to X2n in the lower block 58, a falling-edge enable signal XE/RdnBottom is applied to the energy recovery circuit in the lower block 58. If the falling-edge enable signal XE/RdnBottom is applied to the energy recovery circuit in the lower block 58, the driving signal XBottom begins to fall. At this time, the source capacitor of the energy recovery circuit in the lower block 58 recovers and charges a voltage discharged from the address electrode lines X21 to X2n. An external sustaining disable signal XsusdnBottom is applied to the energy recovery circuit at a half time of the falling-edge enable signal XE/RdnBottom. Then, the driving signal XBottom of the address driver 54B in the lower block 58 drops into a ground voltage level.

When the video data is being supplied to the upper and lower blocks 56 and 58, negative scanning pulses YTopSCAN and YBottomSCAN synchronized with the data pulse are sequentially applied to the first and second scanning/sustaining drivers 50A and 50B for each block. As a result, in the PDP driving method according to the present invention, the driving signal XTop in the upper block 56 and the driving signal XBottom in the lower block 58 are applied in such a manner to overlap with each other.

In other words, the driving signal XBottom at the lower block 58 is applied at a half time of an application period of the driving signal XTop at the upper block 56.

If the address drivers 54A and 54B in the upper and lower blocks 56 and 58 are driven in this manner, then a clock signal XCLK_TOP and the video data Xdata_top for the upper block 56 are supplied at a period (i.e., about 1.2 μs) when the driving signal XTop of the upper block 56 is stabilized into the sustaining level. Thereafter, the clock signal XCLK_BOT and the video data Xdata_bottom for the lower block 58 are applied at a period (i.e., about 1.2 μs) when the driving signal XBottom of the lower block 58 is stabilized into the sustaining level. Herein, assuming that a time required for dividing the video data for the upper and lower blocks 56 and 58 is 0.1 μs, total scanning interval becomes 2.5 μs. At this time, since the driving signals XTop and XBottom should be stabilized into the sustaining level only for a time of 1.2 μs, it becomes possible to generate enable signals XE/RupTop, XE/RupBottom, XE/RdnTop and XE/RdnBottom allowing the energy recovery circuits to be driven for the remaining time of 1.3 μs. As a result, the scanning pulses YTopSCAN and YBottomSCAN can not only be generated for 2.5 μs which is the least time required for the scanning interval, but also the enable signals XE/RupTop, XE/RupBottom, XE/RdnTop and XE/RdnBottom allowing the energy recovery circuits to be driven within a range of 2.5 μs can be overlapped in a period when the driving signals XTop and XBottom are stabilized, so that the scanning interval is shortened to that extent.

As described above, according to the present invention, the driving signals for driving an address driver in each of the upper and lower blocks are applied asymmetrically. Accordingly, since a period when the driving signals for the upper and lower blocks are changed can overlap with a period when the driving signals for other corresponding blocks are stabilized, the scanning interval can be reduced. As a result, a time occupied by the address interval within one frame is minimized, so that it becomes possible to obtain a high-speed driving.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a plasma display panel divided into an upper block and a lower block, said method comprising the steps of:

applying an upper driving signal for supplying a data to address electrode lines provided at the upper block; and applying a lower driving signal for supplying a data to address electrode lines provided at the lower block in such a manner to overlap with the upper driving signal and to utilize asymmetric sustaining.

2. The method as claimed in claim 1, wherein the lower driving signal is applied at an approximately halftime of an application period of the upper driving signal.

3. The method as claimed in claim 1, wherein a period when the upper driving signal falls to a ground potential overlaps with a period when the lower driving signal remains at a stable voltage level.

4. The method as claimed in claim 3, wherein a data at the lower block is supplied at said period when the lower driving signal remains at a stable voltage level.

5. The method as claimed in claim 1, wherein a period when the lower driving signal falls to a ground potential overlaps with a period when the upper driving signal remains at a stable voltage level.

6. The method as claimed in claim 5, wherein a data at the upper block is supplied at said period when the upper driving signal remains at a stable voltage level.

7. The method as claimed in claim 1, further comprising the steps of:

driving an energy recovery circuit at an application time of said driving signals to raise said driving signals into a stable voltage level; and driving the energy recovery circuit after said data was supplied to the corresponding block, thereby falling said driving signals to a ground voltage level.

8. The method as claimed in claim 7, wherein signals for driving the energy recovery circuit have a phase difference between the upper block and the lower block.

9. The method as claimed in claim 1, wherein the upper driving signal and the lower driving signal are applied so as to have a phase difference with respect to each other.

10. A driving apparatus for a plasma display panel utilizing an asymmetry sustaining wherein the plasma display panel is divided into an upper block and a lower block, said driving apparatus comprising:

a first address driver for driving first address electrode lines included in the upper block;

a second address driver for driving second address electrode lines included in the lower block; and control means for applying first and second control signals having a desired phase difference to each of the first and second address drivers.

11. The driving apparatus as claimed in claim 10, wherein the control means includes:

a controller for generating the first and second control signals and applying them to the first and second address drivers; and a delay, being provided between the controller and the second address driver, for delaying the second control signal.

12. The driving apparatus as claimed in claim 11, wherein the delay delays the second control signal such that a driving signal can be applied from the second address driver to the second address electrode lines at an approximately half time of a driving signal applied from the first address driver to the first address electrode lines.

13. The driving apparatus as claimed in claim 10, further comprising:

a first scanning/sustaining driver for driving scanning/sustaining electrode lines included in the upper block;

a second scanning/sustaining driver for driving scanning/sustaining electrode lines included in the lower block; and a common sustaining driver for driving common sustaining electrode lines included in the upper and lower blocks.

14. The driving apparatus of claim 10, wherein the first and second control signals have the desired phase difference so as to utilize asymmetric sustaining.

15. A plasma display apparatus comprising:

a first address driver for applying a first driving signal to a first address electrode line included in a first block;

a second address driver for applying a first driving signal to a second address electrode line included in a second block; and a controller controlling the first address driver and the second address driver in order to partially overlap the first driving signal and the second driving signal.

16. The apparatus of claim 15, wherein the second driving signal is applied at approximately a halftime of an application period of the first driving signal.

17. The apparatus of claim 15, wherein a first portion of the second driving signal overlapping with the first driving signal and a second portion of the second driving signal not overlapping with the first driving signal such that the first and second driving signal partially overlap.

18. The apparatus of claim 15, wherein a data of the first block is supplied to the first address driver when the first driving signal is at a stable voltage level.

19. The apparatus of claim 15, further comprising:

a first scanning/sustaining driver to drive scanning/sustaining electrode lines of the first block;

a second scanning/sustaining driver to drive scanning/sustaining electrode lines of the second block; and a common sustaining driver to drive common sustaining electrode lines of the first and second blocks.

20. The apparatus of claim 15, further comprising:

a first energy recovery circuit driven at an application time of said first driving signal to raise said first driving signal into a stable voltage level, and driven after data is supplied to the first block, thereby said first driving signal falling to a ground voltage level.

21. The apparatus of claim 20, further comprising:

a second energy recovery circuit driven at an application time of said second driving signal to raise said second driving signal into a stable voltage level, and driven after data is supplied to the second block, thereby said second driving signal falling to a ground voltage level.

22. The apparatus of claim 21, wherein signals for driving the first and second energy recovery circuits have a phase difference between the first block and the second block.

* * * * *